United States Patent [19]

Kamimura

[11] 4,153,990

[45] May 15, 1979

[54] POWER TOOL

[75] Inventor: Masato Kamimura, Hamura, Japan

[73] Assignee: Ebrains, Inc., Tokyo, Japan

[21] Appl. No.: 839,455

[22] Filed: Oct. 5, 1977

[30] Foreign Application Priority Data

Oct. 9, 1976 [JP] Japan ..... 51-121645

[51] Int. Cl.[2] ..... B21F 3/04; B21F 15/04

[52] U.S. Cl. ..... 29/751; 140/124; 242/7.17

[58] Field of Search ..... 29/750, 751, 753; 140/115, 119, 122, 124; 242/7.06, 7.17, 7.18; 72/2, 30, 135

[56] References Cited

U.S. PATENT DOCUMENTS

| | | | |
|---|---|---|---|
| 2,649,121 | 8/1953 | Reck | 140/122 X |
| 3,243,130 | 3/1966 | Rebechini et al. | 140/115 |
| 3,717,183 | 2/1973 | Coss | 140/124 |
| 3,903,936 | 9/1975 | Bergmann | 140/124 |
| 3,949,944 | 4/1976 | Bent | 140/124 X |

FOREIGN PATENT DOCUMENTS

| | | | |
|---|---|---|---|
| 780856 | 8/1957 | United Kingdom | 140/119 |
| 926111 | 5/1963 | United Kingdom | 242/7.17 |

*Primary Examiner*—E. M. Combs

*Attorney, Agent, or Firm*—Bacon & Thomas

[57] ABSTRACT

Disclosed is a power tool of pen hold type which comprises, within a substantially tubular case having a tip tapered end, a prime mover, a power transmission mechanism connected to the prime mover, a clutch mechanism connected to the power transmission mechanism, a driven section connected to the clutch mechanism when it is made "on", a collet extending from the driven section axially of the case and exteriorly of the tip tapered end thereof, an index mechanism, a switch operating mechanism, and a power input switch, and in which when an operator depresses the switch operating mechanism with his finger while holding the case just as he holds a writing pen with his hand, the switch is closed and simultaneously the index mechanism is brought to a disengaged condition to permit the clutch mechanism to be brought to an engaged condition to permit a transmission of a rotation force from the prime mover to the collet to make the power tool ready for application to operations, and in which when the operator releases his finger from the switch operating mechanism, due to the return force of the switch the switch operating mechanism is returned to its original condition to permit the switch to be turned off, and simultaneously the clutch mechanism is brought to a disengaged condition to disconnect the driven section from the power transmission mechanism to permit the index mechanism to be made operative to permit the driven section to stop at a specified angular position. Such power tool of pen hold type is simple in construction, light in weight, low in manufacturing cost, and easy to operate and offers a convenience particularly in performing the wire wrapping operation for a highly densified terminal structure.

5 Claims, 6 Drawing Figures

POWER TOOL

This invention relates to a mechanical structure for starting and stopping a mechanism intended to perform the rotating and stopping operations, and more particularly to a power tool characterized by interrupting the transmission of a drive force from a driving section such as an electric motor to a driven section driven to rotate by receiving the drive force and simultaneously stopping abruptly the driven section at a specified angular position.

A wire wrapping tool is known which is used to conduct the wire wrapping for an electric appliance, as a representative example demanded to have the above-mentioned function.

A conventional wire wrapping tool is of pistol type, and is bulky in the whole construction, accordingly heavy in the whole weight as compared with a prime mover used in the tool. Accordingly, this type of wire wrapping tool is indeed suitable to the wire wrapping operation for terminals arranged on a vertically disposed board, but is not suitable to the wire wrapping operation for terminals on a horizontal board.

Further, such wire wrapping tool of pistol type can perform only a very limited function when conducting the wire wrapping operation with respect to the highly densified terminal structure, for example, of an electric appliance wherein very tiny wires are used.

An object of the invention is to provide a small sized power tool which is suitable to an operation for wrapping wires about highly densified terminals and easy to operate and is possessed of an indexing function.

The above object has been achieved by improving the outer configuration of the power tool to that of a pen hold type having a tip tapered end.

According to the invention, a power tool is provided comprising, within a substantially tubular case having a tip tapered end, a prime mover disposed within the case coaxially with the same, a power transmission mechanism connected to the prime mover to transmit a rotation force from the prime mover toward the tip tapered end of the case, a driven section having a collet at its tip end portion and disposed coaxially with the power transmission mechanism, said tip end portion of the driven section projecting exteriorly of the case from the tip tapered end thereof, a clutch mechanism for effecting the connection or disconnection between the power transmission mechanism and the driven section, a power input switch for permitting the supply of power to the prime mover, a switch operating plate disposed slidably toward the axial line of the case within a flat plane taken perpendicularly to the axial line of the case and having a head portion which, when the switch is turned off, is designed to project exteriorly of the case, and having a slot for bringing the clutch mechanism to an engaged or disengaged condition, and an index mechanism connected to the driven section to index the stopping position of the collet, wherein when the switch operating section is depressed by the action of an operator's finger, the index mechanism is brought to a disengaged condition to permit the clutch mechanism to be brought to an engaged condition; the power input switch is turned on to drive the prime mover to rotation; and the rotation force from the prime mover is transmitted to the collet through the power transmission mechanism, clutch mechanism and driven section, and wherein when the switch operating plate ceases to be depressed, it is returned, due to the return force of the power input switch, to its original condition in which its head portion is allowed to project exteriorly of the case, to permit the clutch mechanism to be brought to a disengaged condition thereby to permit the index cam to be brought to an engaged condition; and the power input switch is turned off to permit the driven mechanism and collet to stop at their specified angular position.

Another object of the invention is to provide a power tool which receives only a very small impact when the driven section stops at a specified angular position.

Still another object of the invention is to provide a power tool which is small in size, simple in construction and low in manufacturing cost.

Other objects and features or advantages of the invention will become apparent from the following description made by reference to the appended drawings in which.

Figure 1:
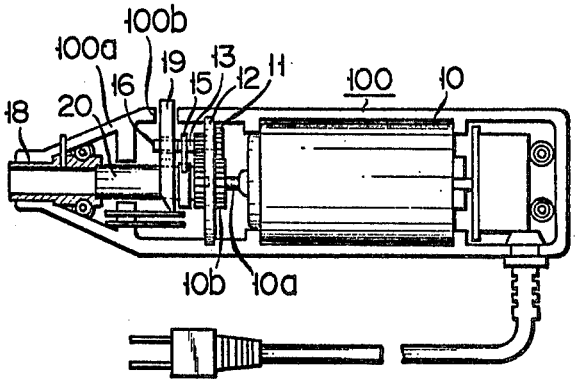
FIG. 1 shows a vertical section of the whole of a power tool according to an embodiment of the invention.

Referring to FIG. 1, a numeral 100 denotes a substantially tubular case of the power tool according to the invention, said tubular case having a tip tapered end portion 100*a*. A motor 10 is disposed concentrically with an axis of said case, and its rotating shaft 10*a* is connected to a gear type power transmission mechanism supported by a circular disc 12 fixed to the case 100, so that power may be transmitted to a second transmission gear 14. The force of rotation of the gear 14 is transmitted to a driven mechanism 20 via a clutch mechanism including a claw plate 15. The driven mechanism 20 takes the form of a shaft, and a collet 18 receiving a bit 50 therein is extended from inside the driven shaft mechanism 20 along the axial line thereof. The tip end portion of the collet 18 is slightly protruded from the tip tapered end portion of the case 100, and a base portion of the collet 18 holds the driven shaft mechanism 20 in place. A switch operating plate or means 19 is inserted into the case 100 from an inserting hole 100*b* provided in the same, so as to be movable toward the axis of the case 100 within a specified spatial interval at a flat plane taken at right angles to the axial line of the case 100. This switch operating means 19 so acts as to cause contact or separation of a pair of its plate springs constituting a switch 22 with or from each other and simultaneously as to cause the claw plate to be rocked about its transmission gear shaft 13 by engagement of the clutch gear shaft 16 with a slot 19*a* of the switch operating means 19 to cause the clutch mechanism to carry out its engaging or disengaging operation. The claw 15*a* of the claw plate 15 as one component of an index mechanism is engaged with a notch 20b of an index cam 20a as the other component of the index mechanism to index the stop position of the driven shaft.

Hereinafter, the power tool of the invention will be explained further in detail by reference to FIG. 2.

Figure 2:
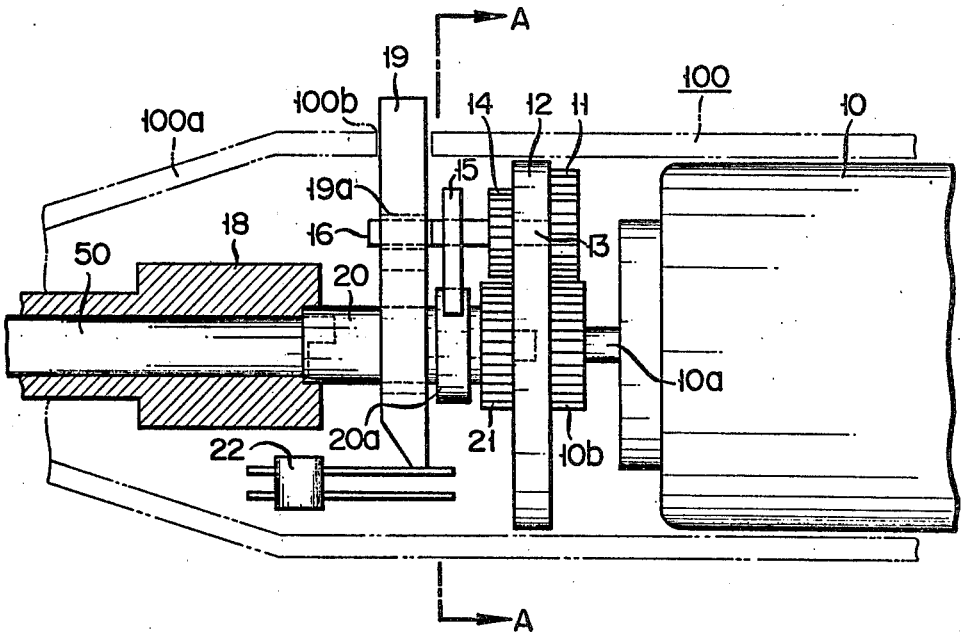
FIG. 2 is a schematic, partially enlarged, vertically sectional view of an electric power tool of the invention.

FIG. 2 is a detailed view of a wire wrapping tool according to an embodiment of the invention with an electric motor as its prime mover, and shows the construction of the main part of the tool having an indexing function which is directed to determining the stopping position of the driven shaft at which the rotation of the driven shaft is stopped. Referring to FIG. 2, a case indicated by a numeral 100 is of substantially tubular shape and its tip end portion 100a is tapered. Within the case 100 the electric motor 10 is installed. A motor gear 10b is secured to a rotating shaft 10a of the electric motor 10 to permit the rotation force of the same 10 to be transmitted to a first transmission gear 11 via the motor gear 10b. A power transmission shaft 13 rotatably held in place by a circular disc 12 is fixed with the first transmission gear 11 and second transmission gear 14 with the circular disc 12 sandwiched between both gears 11 and 14. Accordingly, when having received the force of rotation of the electric motor 10 via the motor shaft 10a, the first transmission gear 11, the power transmission shaft 13 and the second transmission gear 14 are caused to rotate integrally with each other.

The claw plate 15 is attached to one end of the power transmission shaft 13 so as to be freely rocked about the same 13 through an appropriate or specified angle independently from the rotation of the same 13.

Figure 4:
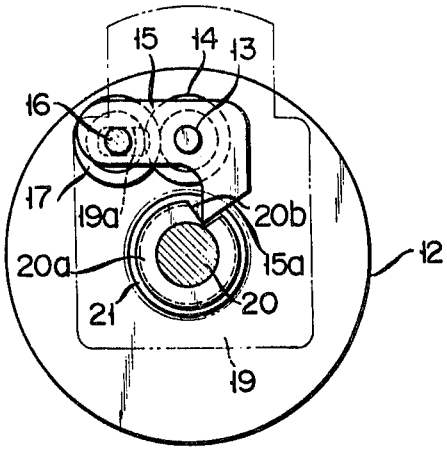
FIG. 4 is a front view taken along line A—A of FIG. 2 in an arrowed direction, showing an indexed condition of the driven section wherein the same is indexed.
Figure 5:
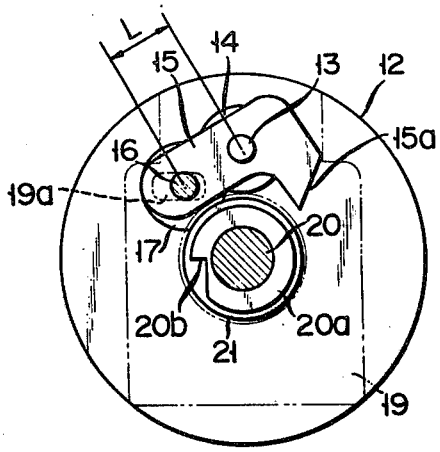
FIG. 5 is a front view taken along the line A—A of FIG. 2 in the arrowed direction, showing a condition wherein power transmission is rendered effective.

FIGS. 4 and 5 show states of the claw plate 15 before and after the rocking of the same about the shaft 13 through an appropriate angle, respectively As illustrated in FIG. 4, a clutch gear shaft 16 is secured to the claw plate 15 at a position permitting the gear 17 to be intermeshed with the gear 14 to serve as one means to transmit the rotation force of the electric motor 10. A clutch gear 17 is rotatably fitted over the clutch gear shaft 16. The switch operating means 19, a part of which is protruded from said inserting hole 100b of the case 100, is so held in place as to be movable within a specified spatial interval in a direction taken at right angles to the axial direction of the collet 18 shown in FIG. 2. Simultaneously, the clutch gear shaft 16 is fitted into the slot 19a provided in the switch operating means 19 so that the claw plate 15 may be rocked about the shaft 13 through a specified angle depending upon the movement of the switch operating means 19. A bit is secured to the driven shaft mechanism 20 so as to permit both the bit and the mechanism 20 to rotate jointly with each other. A circular disc-like cam 20a is secured to the driven shaft mechanism 20 integrally with a driven shaft gear 21. As shown in FIG. 5, the rotation force of the electric motor 10 is transmitted through the gears 14, 17 and, when the claw plate 15 has been rocked about the shaft 13, said clutch gear 17 is intermeshed with the driven shaft gear 21 to permit the rotation of the driven shaft mechanism 20. Thus, the distance L (FIG. 5) between the axis of the transmission mechanism shaft 13 and the axis of the clutch gear shaft 16 should be equal to half the sum of the respective pitch circle diameters of the second transmission gear 14 and the clutch gear 17.

A part of the circumferential portion of the index cam 20a is provided with a depression or notch 20b, with which a claw portion 15a of the claw plate 15 is to be intermeshed. When the rotation of the driven shaft 20 is stopped, said claw portion 15a and said notch 20b are intermeshed with each other to permit the driven shaft 20 to be stopped at a specified angular position. The index mechanism comprised of the claw plate 15 and the index cam 20a is allowed to function as such.

The said switch 22 comprised of said paired plate springs as it contacts, is disposed below the switch operating means 19, and is turned on or off by the vertical movement of the switch operating means 19 to cause an electric circuit of the motor 10 to be energized or deenergized.

The main construction of the wire wrapping tool according to the said embodiment has been above explained, and hereinafter the operation of the wire wrapping tool will be explained.

First, a bit is installed into the collet 18, which bit has two axially extending holes, one of which is a terminal hole located at the center of the cross section of the bit and is to be fitted with a terminal desired to be wrapped with a wire, and the other of which is a wire hole which is to be fitted with a wire for wrapping the terminal. Next, when the switch operating means 19 is depressed, the claw plate 15 previously kept in the position of FIG. 4 is rocked about the transmission gear shaft 13 and is thus brought to the position of FIG. 5 wherein the clutch gear 17 is intermeshed with the driven shaft gear 21. At this time, the claw portion 15a of the claw plate 15 is disengaged from the notch 20b provided in the cam 20a of the driven shaft mechanism 20 to make the driven shaft mechanism 20 freely rotatable. Simultaneously with said depression of the switch operating means 19, the paired plate springs are brought into contact with each other to permit the electric motor 10 to start its rotation.

The rotation force of the electric motor 10 is transmitted to the motor gear 10b, the first transmission gear 11, the second transmission gear 14 and the clutch gear 17 supported by the claw plate 15 in the order mentioned finally to cause the rotation of the driven shaft gear 21 secured to the driven shaft mechanism 20, thereby to cause the rotation of the bit.

Next, when one wire wrapping operation is completed and the finger is released from the switch operating plate 19 the paired plate springs theretofore kept in contact are separated from each other, the switch operating plate 19 is pushed up to its original position by the spring force of the plate springs 22, and simultaneously the plate springs become out of contact to permit the electric motor 10 to stop its rotation.

Further, the relative position of the claw plate 15, the clutch gear 17 and driven shaft gear 21 kept in the position of FIG. 5 during the said one wire wrapping operation is changed to that illustrated in FIG. 4 simultaneously with the completion of the one wire wrapping operation. That is, the gear 17 is disengaged from the driven shaft gear 21 to interrupt the transmission of the rotation force from the clutch gear 17 to the driven shaft gear 21. Then, as shown in FIG. 4, the claw plate 15 comes to engage the notch 20b of the index cam 20a to be intermeshed with the same 20b, whereby to cause the driven shaft mechanism 20, accordingly the bit, to stop at a specified angular position.

This indexing operation is performed within an extremely short period of time when actually done. Therefore, even after the separation of the paired plate springs for driving the electric motor 10, it continues, for a while, to rotate due to its inertia. However, the driven shaft mechanism 20 required to stop its rotation instantaneously, when the same is stopped, receives only a very small impact due to its small inertia since the rotation force transmitted to the mechanism 20 from the electric motor 10 is already fully interrupted by disengagement of the clutch mechanism. This is a practically preferable function not only for the electric motor 10 but also for the other power transmission gears.

Further, as described in the above-mentioned embodiment, the wire wrapping tool according to the invention has an outer configuration of pen hold type and is constructed such that the switch operating plate 19 is designed to make no rotation but made slidable toward the axis of the tubular body of the tool; and in addition that the gears 10*b*, 11, 14, 17 and 21 for power transmission and the claw plate 15 and cam 20*a* for indexing the stopping position of the driven shaft 20 are all made unmovable axially of the tubular body of the tool but made rotatable or rockable only radially of said tubular body. Therefore, the wire wrapping operation can be carried out within the substantially tubular case 100 of a limited size, so that the outer diameter of the electric motor 10 can be made equal to a maximum inner diameter of the case 100, for example, as shown in the above-mentioned embodiment. Thus, the wire wrapping tool can be miniaturized and fit the wire wrapping operation for wrapping a wire around each of highly densified terminals.

Within the present tool, the axial movement of the clutch is not made which, in a conventional tool, however, was designed to be performed. This eliminates the necessity of pulling a trigger-like member. Further, the tool according to the invention offers a perfect convenience of pushing with the index finger the switch operating means provided at a near-the-tip-end portion of the pen hold type tool while holding the same with a natural attitude just as you hold a writing pen. Further, since the tool according to the invention is of pen hold type, it can be made much simpler in the configuration of the case, mush easier to manufacture and much lower in manufacturing cost than the tool of pistol or other conventional types.

Figure 3:
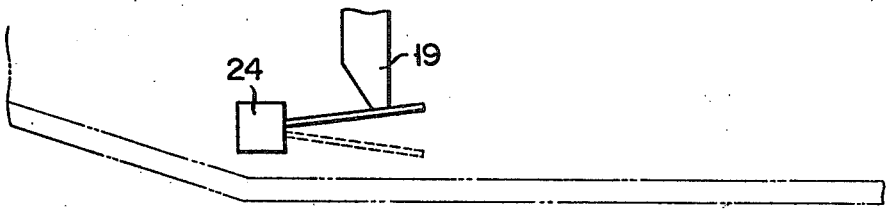
FIG. 3 is a partial view showing an opening and closing device for a compressed air supply valve of a pneumatic power tool of the invention.

FIG. 3 shows a switching device used in the case where the prime mover is a pneumatic motor. A compressed air supply valve 24 is closed when its arm is located at a position illustrated in a solid line in FIG. 3 and is opened when its arm is depressed up to a position illustrated in a dotted line in FIG. 3. The valve 24, when the switch operating means 19 has ceased to be depressed, automatically pushes the means 19 to its upward closed position.

Figure 6:
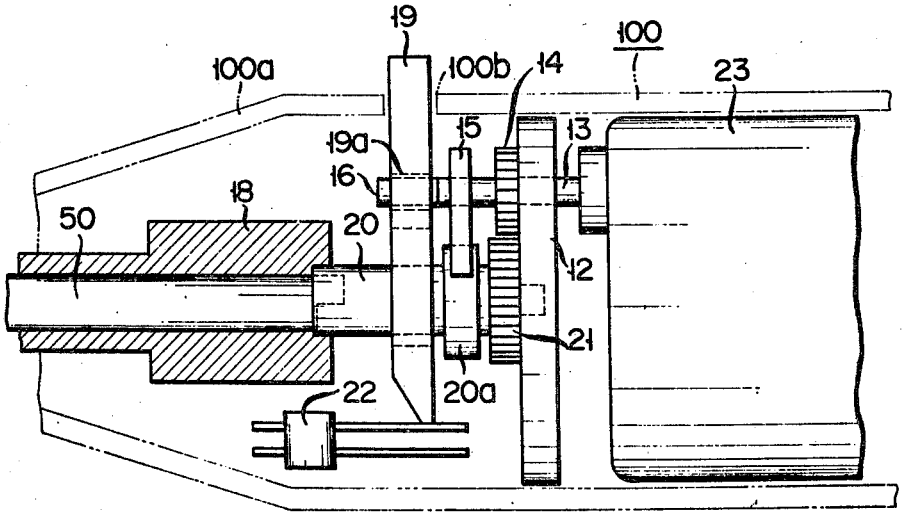
FIG. 6 is a schematic, partially enlarged, vertically sectional view of the power tool according to another embodiment of the invention in which the prime mover is an electric motor with a reduction gear.

FIG. 6 shows a wire wrapping tool using as the prime mover an electric motor with a reduction gear, wherein the motor gear 10*b* and the first transmission gear 11 of the drive force transmission mechanism are omitted from the tool to simplify the structure of the tool.

The above description has been made for explaining the embodiment of the invention directed to the wire wrapping tool as one of the power tools. By replacement of the foregoing bit with other various bits, however, the wire wrapping tool of the invention can be applied to any other use such as a screw fastener tool or automatic assembler tool in which the bit is required to stop at a specified position.

In the above-mentioned embodiment of the invention, the switch operating means 19 was provided at the tubular portion of the case which is situated in the proximity of the tip tapered end portion of the case, but may be provided at this tapered portion. Further, the switch operating means may be provided not at right angles to the axial line of the case but at a specified angle taken with respect thereto. Furthermore, the time of contact operation can also be set by adjusting the elastic force of the paired plate spring contacts below the switch operating means 19. Furthermore, these plate spring contacts can also be made of other shapes of member. Needless to say, this invention can be modified in various forms without departing from the object and scope of the invention.

I claim:

1. A power tool comprising: a substantially tubular case having a tip tapered end, a prime mover disposed within the case coaxially with the same, a power transmission mechanism connected to the prime mover to transmit a rotation force from the prime mover toward the tip tapered end of the case, a driven section having a collet at its tip end portion and disposed coaxially with the power transmission mechanism, said tip end portion of the driven section projecting exteriorly of the case from the tip tapered end thereof, a clutch mechanism for selectively connecting the power transmission mechanism to the driven section, a power input switch for supplying power to the prime mover, a switch operating plate slidably disposed on said case for movement toward the axis of the case, lying within a plane perpendicular to the axis of the case and having a head portion which, when the switch is turned off, projects exteriorly of the case, said plate having a slot engaged by an element of said clutch mechanism for bringing the clutch mechanism to an engaged state, and an index mechanism connected to the driven section to index the stopping position of the collect, wherein when the switch operating plate is depressed by finger action of the operator, the index mechanism is brought to a disengaged state and the clutch mechanism is brought to an engaged position; the power input switch is turned on to energize the prime mover; and the rotation force from the prime mover is transmitted to the collet through the power transmission mechanism, clutch mechanism and driven section, and wherein when the switch operating plate is released, it is returned due to the return force of the power input switch, to its original position in which its head portion projects exteriorly of the case, and the clutch mechanism is brought to a disengaged condition thereby to permit the index cam to be brought to an engaged state; and the power input switch is turned off to permit the driven mechanism and collect to stop at their specified angular position.

2. A power tool according to claim 1 wherein the prime mover is an electric motor; and the power input switch has a pair of contacts made of plate springs.

3. A power tool according to claim 1 wherein the prime mover is a pneumatic motor; the power input switch is a compressed air supply valve having an arm projecting exteriorly of the valve, which arm returns to its original position by its return force when it is not depressed by the switch operating plate.

4. A power tool according to claim 2, wherein the power transmission mechanism includes a prime mover gear fixed to a shaft of the prime mover, a power transmission mechanism shaft rotatably supported parallel to the axis of the case by a circular disc fixed to the case at right angles to the axis of the case, first and second transmission gears fixed to the power transmission mechanism shaft on opposite sides of the circular disc, said first transmission gear being intermeshed with the prime mover gear; the clutch mechanism includes a claw plate, the axis of which intersects the axis of the power transmission mechanism shaft at right angles and which is supported by the power transmission mechanism shaft so as to be rotatable around the same, a clutch gear shaft fixed on the claw plate extending at right angles thereto, at a position spaced at a specified distance L from a center of the power transmission mechanism shaft, and a clutch gear supported rotatably on the clutch gear shaft, said specified distance being equal to half the sum of the respective pitch circle diameters of the second transmission gear and the clutch gear, said clutch gear shaft having a portion extending through said slot of the switch operating plate; the driven portion including a driven shaft and driven shaft gear which are fixed to a rear end portion of the driven shaft; and the index mechanism includes a claw provided at one end of the claw plate so as to move toward the axis of the case and a notch provided at one point of the outer periphery of the driven portion at a position opposing the claw plate, the claw being engaged with the notch when the claw plate is rocked about the power transmission mechanism shaft inwardly of the clutch mechanism.

5. A power tool according to claim 3, wherein the power transmission mechanism includes a prime mover gear fixed to a shaft of the prime mover, a power transmission mechanism shaft rotatably supported parallel to the axis of the case by a circular disc fixed to the case at right angles to the axis of the case, first and second transmission gears fixed to the power transmission mechanism shaft on opposite sides of the circular disc, said first transmission gear being intermeshed with the prime mover gear; the clutch mechanism including a claw plate, the axis of which intersects the axis of the power transmission mechanism shaft at right angles and which is supported by the power transmission mechanism shaft so as to be rotatable around the same, clutch gear shaft on the claw plate and extending at right angles thereto, at a position spaced at a specified distance L from a center of the power transmission mechanism shaft, and a clutch gear supported rotatably on the clutch gear shaft, said specified distance being equal to half the sum of the respective pitch circle diameters of the second transmission gear and the clutch gear, said clutch gear shaft extending into proximity to the circular disc and end thereof extends through said slot of the switch operating plate; the driven portion including a driven shaft and driven shaft gear which are fixed to the driven shaft; and the index mechanism includes a claw provided at one end of the claw plate so as to move toward the axis of the case and a notch provided at one point of the outer peripheral surface of an index cam fixed on the outer periphery of the driven portion at a position opposing the claw plate, the claw being engaged with the notch when the claw plate is rocked about the power transmission mechanism shaft inwardly of the clutch mechanism.

* * * * *